US008372356B2

(12) United States Patent
Warhurst et al.

(10) Patent No.: US 8,372,356 B2
(45) **Date of Patent: *Feb. 12, 2013**

(54) MANUALLY DIRECTED, MULTI-CHANNEL ELECTRONIC PIPETTING SYSTEM

(75) Inventors: Julian Warhurst, Ashland, MA (US); Gary Nelson, Hollis, NH (US); Richard Cote, Bolton, MA (US)

(73) Assignee: Integra Biosciences Corp., Hudson, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/099,782

(22) Filed: May 3, 2011

(65) Prior Publication Data

US 2011/0268627 A1 Nov. 3, 2011

Related U.S. Application Data

(60) Provisional application No. 61/330,541, filed on May 3, 2010.

(51) Int. Cl.
*B01L 3/02* (2006.01)

(52) U.S. Cl. ..... 422/509; 422/511; 422/516; 422/522; 422/524; 422/525; 73/863.32; 73/864; 73/864.01; 73/864.11; 73/864.24; 73/864.25

(58) Field of Classification Search ..... 422/509, 422/511, 516, 519–522, 524–525, 63–68.7; 73/863.32, 864, 864.01, 864.11, 864.13, 73/864.16–864.21, 864.25, 864.31
See application file for complete search history.

(56) References Cited

U.S. PATENT DOCUMENTS 4,478,094 A * 10/1984 Salomaa et al. ..... 73/863.32
5,116,180 A 5/1992 Fung et al.
6,360,792 B1 3/2002 Ganz et al.
6,982,063 B2 1/2006 Hamel et al.
7,540,205 B2 6/2009 Nelson et al.
7,662,343 B2 2/2010 Mathus et al.
7,662,344 B2 2/2010 Mathus et al.
8,033,188 B2 10/2011 Kalmakis et al.
2005/0249635 A1 11/2005 Okun et al.
2006/0048846 A1 3/2006 Roenneburg et al.
2007/0221684 A1 9/2007 Steinbrenner et al.
2009/0074622 A1 3/2009 Kalamakis et al.

(Continued)

FOREIGN PATENT DOCUMENTS

WO 2009/130318 10/2009

OTHER PUBLICATIONS

Rainin Pipetting 360° Simultaneous 96-well pipetting, Fast manual benchtop system, 2009 Rainin Instrument, LLc, PB-210 LIQ RevB, 2 pgs.

(Continued)

*Primary Examiner* — Brian R Gordon
(74) *Attorney, Agent, or Firm* — Andrus, Sceales, Starke & Sawall, LLP

(57) ABSTRACT

A manually directed, multi-channel electronic pipetting system is designed to transfer liquids from a standard multi-well plate, deep-well plate or reservoir into another multi-well plate. The preferred pipetting head includes an array of 96-tip fittings. A deck with at least one but preferably two or more wellplate nesting receptacles holds one or more multi-well plates or reagent reservoirs for access by an array of disposable pipette tips mounted to the pipetting head. The electronic motion control system includes a control handle that is mounted to a load cell, the carriage for the pipetting head and is held in the palm of the user. In use, the user grasps the control handle and operates the system in a manner similar to one using a handheld electronic pipettor.

23 Claims, 14 Drawing Sheets

U.S. PATENT DOCUMENTS

| | | | | |
|---|---|---|---|---|
| 2009/0274587 | A1 | 11/2009 | Butz et al. | |
| 2011/0209564 | A1* | 9/2011 | Von Beichmann et al. | 73/864.01 |
| 2011/0268628 | A1 | 11/2011 | Warhurst | |
| 2011/0296931 | A1 | 12/2011 | Warhurst | |

OTHER PUBLICATIONS

Rainin Pipetting 360° Liquidator 96, Manual benchtop pipetting system, 2008 Rainin Instrument, LLC, 9920-360 Rev. B, 16 pgs.

CyBi—Well Pipettor User Manual, Release Sep. 2008, 88 pgs.

Thermo Scientific Matrix Hydra II, Product Specification, 2008 Thermo Fisher Scientific, Inc., 2 pgs.

Thermo Scientific Matrix PlateMate 2×3, Product Specification, 2007 Thermo Fisher Scientific, Inc., 2 pgs.

Thermo Scientific Matrix PlateMate Plus, Product Specification, 2007 Thermo Fisher Scientific, Inc., 2 pgs.

* cited by examiner

MANUALLY DIRECTED, MULTI-CHANNEL ELECTRONIC PIPETTING SYSTEM

FIELD OF THE INVENTION

The invention relates to a manually directed, multi-channel electronic pipetting system which includes a multi-channel pipetting head having a plurality of pipetting channels arranged in an array or rows and columns.

BACKGROUND OF THE INVENTION

Multi-well plates, also known as microtiter plates or microwell plates, are standard products in clinical and research laboratories. A multi-well plate is a flat plate with multiple wells used as individual test tubes. The most common multi-well plates include 96-wells or 384-wells arranged in a rectangular matrix. ANSI has set standardized dimensions and SBS footprints for well-plates. For example, a 96-well plate has 8 rows and 12 columns of wells centered 9 millimeters centerline-to-centerline. A typical 384-well plate includes 16 rows and 24 columns of wells with a centerline-to-centerline distance of 4.5 millimeters. Multi-well plates with 1536 wells and higher are also available. Some multi-well plates are designed to hold larger volumes than a standard multi-channel plate yet maintain the standard centerline-to-centerline dimensions. These well-plates are taller and are commonly called deep well-plates.

In the laboratory, multi-well plates are filled with various liquid samples, and it is routine to transfer liquid samples from one multi-well plate to another in order to implement assays or store duplicate samples. It is also routine to transfer liquid reagents or samples from a common reservoir to either a standard multi-well plate or a deep well-plate. In some cases, hand-held, multi-channel pipettes, for example 8 or 12 channels, are used to draw some or all the liquid from a set of wells in a wellplate and transfer aliquots into another set of wells on the same wellplate or another wellplate. In order to produce a high volume of prepared multi-well plates, automated liquid handling machines have been developed to provide much higher throughput than a technician, even with a multi-channel pipettor. In the art, there are several types of automated liquid handling machines to automatically fill multi-well plates. Such automated liquid handling machines typically use sophisticated Cartesian robots for positioning syringes and/or pipette tips, as well as shuttling well-plates from storage and into position for liquid transfer. Most of these automated liquid handling machines are rather expensive, and also quite large. Many include sophisticated computer control which requires extensive training, as well as setup and programming.

Such automated high-throughput systems are not practical for some applications. In order to address this need, the prior art also includes a simultaneous 96-well manual pipetting system sold under the trade name Liquidator 96. This fully manual system includes an array of pipette tip fittings matching the dimensions of a standard 96-well plate. Disposable pipette tips are mounted to the 96-fittings. The system aspirates and dispenses liquid from the 96-pipette tips simultaneously. Because the system is fully manual, it lacks the ability to program precise protocols and liquid transfer amounts. For example, an electronic hand-held pipettor, or an automated liquid handling system, can be programmed to aspirate a precise volume of liquid reagent or sample and then dispense the aspirated volume, sometimes as a series of equal-volume aliquots in successive dispensing operations. Programmable electronic hand-held pipettors as well as automated liquid handling systems can also be configured to do quite complex pipetting operations, such as mixing, repeat pipetting, diluting, etc.

While programmable, automated liquid handling systems have many desirable features over a fully manual 96-well liquid transfer system, they are generally too large and expensive for use in certain laboratory applications. Therefore, in many applications, laboratory technicians are resigned to using multi-channel hand-held pipettors, which may be quite time-consuming.

SUMMARY OF THE INVENTION

The invention is a manually directed, multi-channel electronic pipetting system for transferring fluids from a standard multi-well plate, a deep-well plate, a rack of sample tubes or a reservoir into another multi-well plate. The term wellplate as used herein refers to both standard well-plates and deep well-plates.

An electronic multi-channel pipetting system constructed in accordance with the invention includes a multi-channel pipetting head in which the channels are arranged in a two-dimensional array of rows and columns. In the exemplary embodiment, the pipetting head includes an array of 96-tip fittings corresponding to an array of 96-channels. A pipetting motor is contained within a carriage for the pipetting head, and drives the pipetting head to aspirate and dispense. Disposable pipette tips are mounted onto the array of tip fittings in order to transfer liquid samples or reagents from one multi-well plate or reservoir to another multi-well plate. Alternatively, the pipette tips can be mounted using a magazine.

The system includes a deck with at least one, but preferably two or more wellplate nesting receptacles for holding a multi-well plate or a reagent reservoir. The system also includes a control handle. Preferably, the control handle is mounted to the carriage for the pipetting head, and resembles a handle for a hand-held electronic pipettor. The preferred control handle is the same or quite similar to that disclosed in U.S. Pat. No. 7,540,205 issued Jun. 2, 2009, entitled "Electronic Pipettor", application Ser. No. 11/856,231 by Gary E. Nelson, George P. Kalmakis, Kenneth Steiner, Joel Novak, Jonathon Finger, and Richard Cote, filed on Sep. 17, 2007, assigned to the assignee of the present application and incorporated herein by reference. The control handle is preferably mounted to a load cell that is attached to a carriage for the pipetting head. The load cell detects force exerted on the control handle when a user exerts pressure on the handle and outputs a corresponding signal to an electronic motor control system. In use, the user grasps the control handle in a manner similar as when using a hand-held electronic pipettor, and exerts pressure on the control handle to move the pipetting head with respect to the well-plates or reservoirs on the deck. The load cell preferably includes a plurality of strain gauges to detect the direction and amount of force that the user exerts on the control handle. The control system moves the multi-channel pipetting head with respect to the deck, accordingly, so that the user can align the pipette tips with the appropriate wellplate or reservoir on the deck.

In the exemplary embodiment of the invention, the carriage is mounted to a tower that contains a motorized, vertical drive mechanism for raising and lowering the pipetting head with respect to the wellplate deck. A motorized, horizontal drive mechanism moves the tower and the pipetting head laterally in response to the sensed lateral force exerted on the control handle. For example, if the user presses on the control handle from left to right, the tower along with the pipetting head moves from left to right. If the user pulls upward on the control handle, or pushes downward on the control handle, the vertical drive mechanism raises or lowers the pipetting head accordingly. The speed of the two-dimensional movement of the pipetting head (i.e., x-axis and z-axis) is controlled by the electronic motion control system. Preferably, the speed is normally in proportion to the amount of force detected by the load cell, however, the electronic motion control system decelerates the pipetting head as it approaches mechanical displacement limits. As an alternative to moving the tower and the pipetting head laterally in response to the detected force exerted on the control handle, it is possible within the spirit of the invention to maintain the tower in a fixed lateral position and move the deck laterally to the left or right in response to the user's use of the control handle.

As mentioned, the control handle is preferably similar to that disclosed in the above-incorporated U.S. Pat. No. 7,540,205 entitled "Electronic Pipettor". The control handle therefore preferably includes an elongated body adapted to be held in the hand of the user. On its front side, it has a touch wheel control that is operated by the user, as well as a dot matrix user interface display, which is located above the touch wheel control. The preferred system also includes several microprocessors. In an exemplary embodiment of the invention, one of the microprocessors is located within the control handle, although locating a microprocessor in the control handle is not necessary to carry out the invention. The preferred system includes menu-driven software for controlling the information displayed on the user interface display and for programming the one or more microprocessors that operate the system. A circular touch pad in the touch wheel control translates rotational movement of the user's thumb or finger into cursor movements on the display in order to navigate the menu-driven software. The menu-driven software is, in many respects, similar to the software disclosed in application entitled "Pipettor Software Interface", application Ser. No. 11/856,232 by Gary Nelson, George P. Kalmakis, Gregory Mathus, Joel Novak, Kenneth Steiner and Jonathon Finger, filed Sep. 17, 2007, now U.S. Pat. No. 8,033,188, issued Oct. 11, 2011, assigned to the assignee of the present application and incorporated herein by reference. For example, the software provides graphic displays for adjusting volume, relative pipetting speed, pace and count for the various programmed pipetting procedures. The software also preferably provides multiple programmable pipetting modes based on predetermined algorithms such as pipette, repeat pipette, sample dilute, pipette/mix, manual pipette, reverse pipette, variable dispense, variable aspirate, sample dilute/mix, and serial dilution. These functional modes are based on predetermined algorithms embedded in the software to implement respective, well known pipetting procedures, although various parameters such as volume, speed, pace, count, direction, and mixing are available for programming and editing for the user. In addition, the preferred software includes a custom programming mode in which the user can create custom pipetting procedures based on the steps of aspirating, mixing, dispensing and purging. The preferred software also includes other features as well.

Another aspect of the invention is directed to the tip ejection mechanism. Preferably, an ejector button is located on the control handle similar as in a single-channel or multi-channel, hand-held pipettor. A sensor on the control handle detects that the ejector button has been activated and relays a signal to an electronic control system to activate an automated tip stripping mechanism on the multi-well pipetting head. Preferably, the same motor responsible for moving the pistons on the pipetting head to aspirate and dispense is driven into an over-extended condition in order to move a stepped stripping plate to eject the disposable pipette tips from the tip fittings. The use of the stepped stripping plate enables groups of tips to be sequentially removed from the tip fittings, thereby reducing the instantaneous torque load on the motor. In a preferred embodiment, menu-driven software displayed on a user interface on the control handle provides an ejection confirmation inquiry after the ejector button is activated but prior to transmitting the control signal to strip the pipette tips.

In another embodiment of the invention, the system is designed to hold only one multi-well plate or reservoir on the deck. In this embodiment, the system does not require a horizontal drive mechanism, and the pipetting head does not move laterally with respect to the deck. The vertical drive mechanism, however, moves the pipetting head vertically upward and downward in response to upward and downward pressure exerted on the control handle. In this embodiment, the user needs to place and remove individual multi-well-plates and/reservoirs from the receptacle nests on the deck. In another similar embodiment, the lateral position of the deck with respect to the pipetting head can be moved manually.

In yet another embodiment, the pipetting head is able to move laterally in a direction perpendicular to the X-direction, for example by including a Y-axis drive mechanism which is responsive to the control handle. In this embodiment of the invention, it is preferred that the carriage for the pipetting head be mounted to a gantry rather than to a tower. One of the advantages of this embodiment of the invention is that allows access to two rows of well-plates on the deck. Another advantage is that it allows motorized, accurate positioning of the pipette tips in the Y-axis direction, which is helpful when dispensing into 384-well plates.

If desired, the X-axis lateral drive, or the combination of the X-axis and Y-axis horizontal drives can be replaced by a rotational axis horizontal, and perhaps with a radial extender drive.

In still another embodiment, relative vertical and horizontal, or vertical only, motion between the carriage and pipetting head on the one hand and the deck on the other hand is implemented in a manual fashion. In this embodiment, the pipetting is still implemented in an electronic fashion, and is preferably controlled by using a user interface on a control handle. Other advantages and modifications to the invention may be apparent to those of ordinary skill in the art upon reviewing the following drawings and description thereof.

BRIEF DESCRIPTION OF THE DRAWINGS

FIG. 9 illustrates the tower being in the left hand side receptacle position.

DETAILED DESCRIPTION OF THE DRAWINGS

Figure 1:
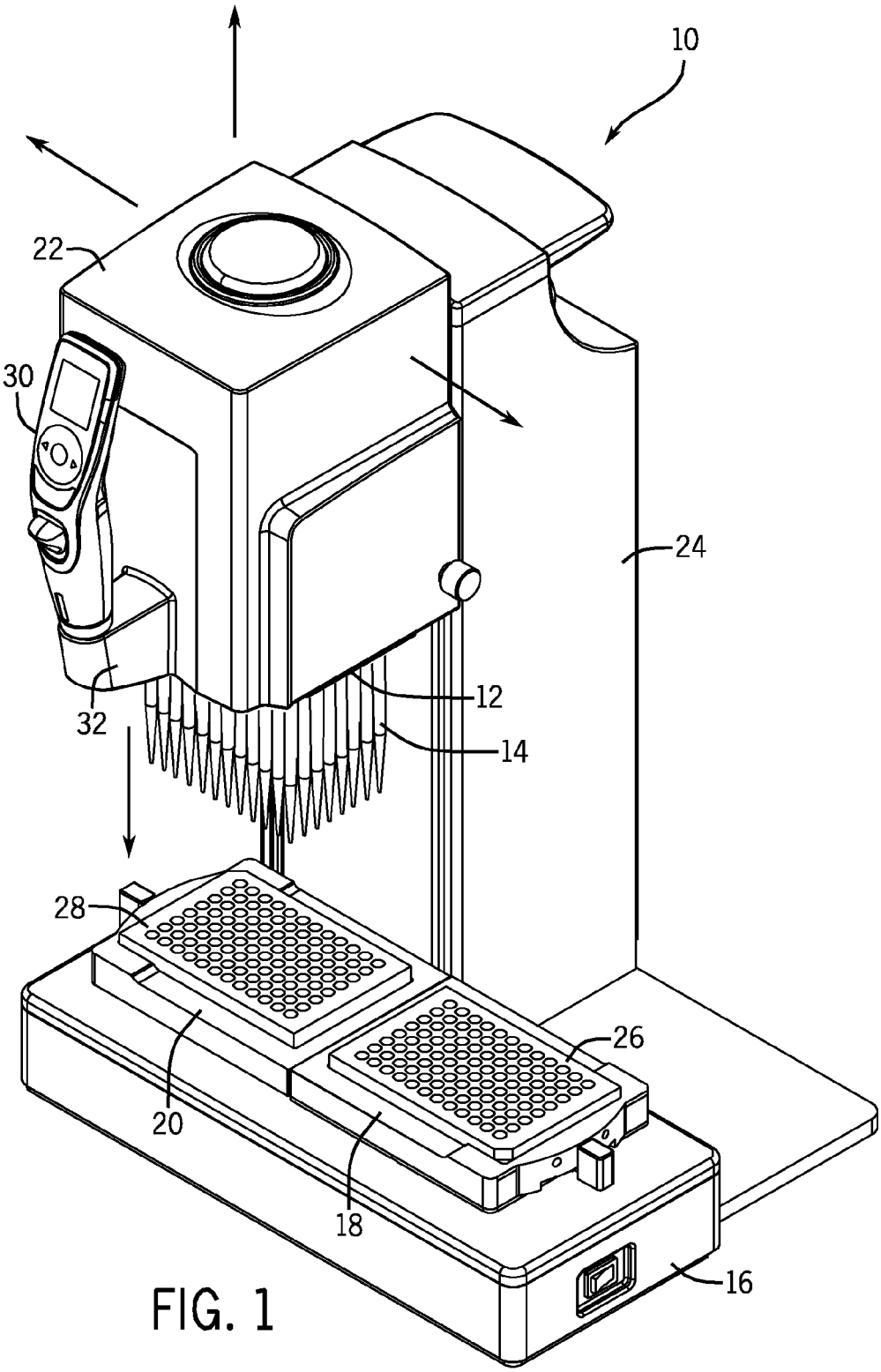
FIG. 1 is a perspective view of a manually directed, multi-channel electronic pipetting system constructed in accordance with an exemplary embodiment of the invention.
Figure 2:
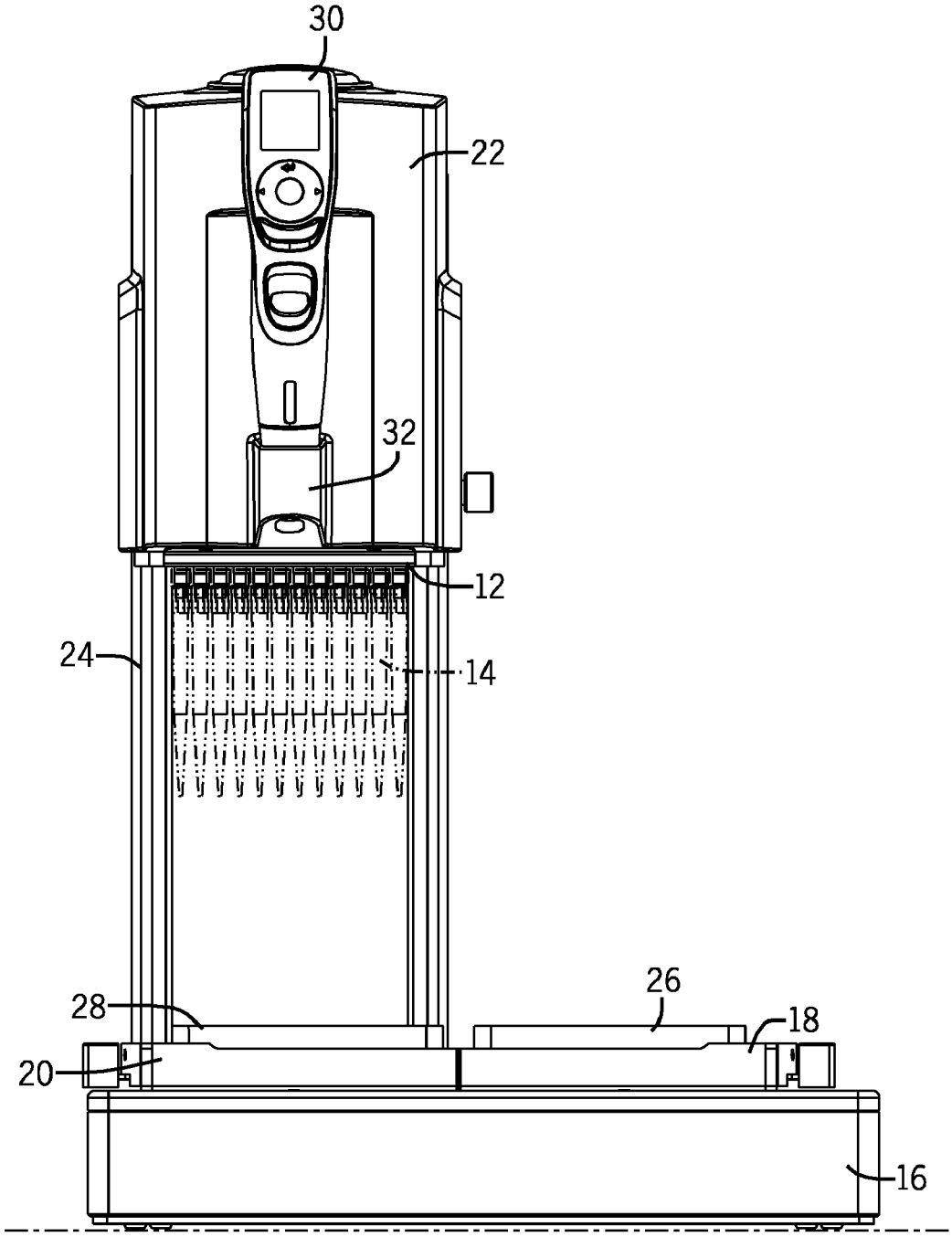
FIG. 2 is a front elevational view of the multi-channel pipetting system illustrated in FIG. 1.
Figure 3:
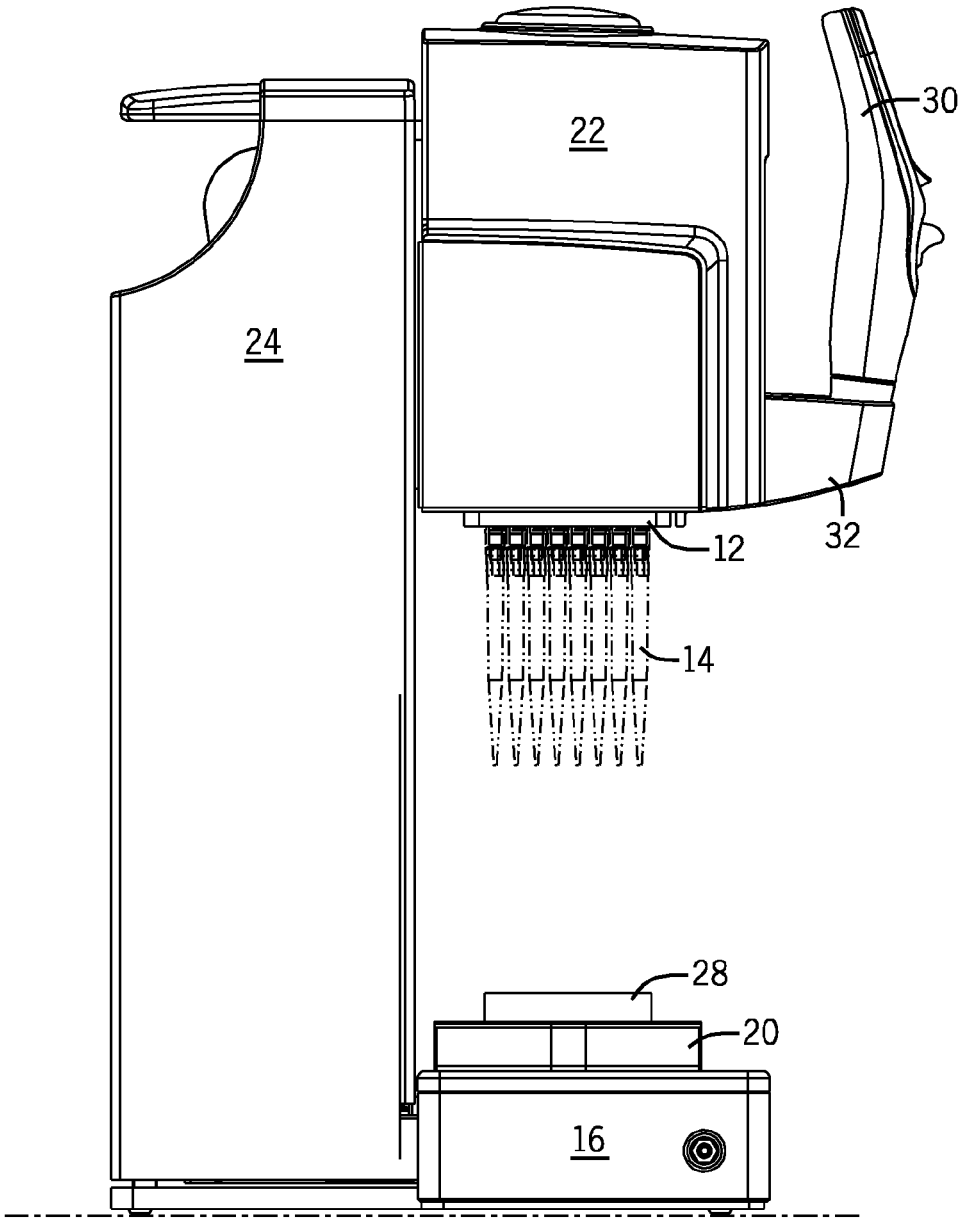
FIG. 3 is a side elevational view of the manually directed, multi-channel electronic pipetting system illustrated in FIGS. 1 and 2.

A first embodiment of a manually directed, multi-channel electronic pipetting system 10 constructed in accordance with the invention is illustrated in FIGS. 1-14. Referring to FIGS. 1-3, the manually directed, multi-channel electronic pipetting system 10 includes a multi-channel pipetting head 12 having a plurality of pipetting channels arranged in a two dimensional array of rows and columns. Normally the pipetting head 12 will include an array of 96-tip fittings. An array of pipette tips 14 are attached to the multi-channel pipetting head 12. The manually directed, multi-channel electronic pipetting system 10 includes a flat deck 16 supporting a right nesting receptacle 18 and a left nesting receptacle 20. The nesting receptacles 18, 20 are designed to hold multi-well plates, racks of storage tubes or reservoirs in a known location on the deck 16. The nesting receptacles 18, 20 can be attached to the deck 16 or can be made integral with the deck 16.

The pipetting head 12 is removably mounted to a carriage 22 which in turn is mounted to a tower 24. A pipetting motor located within the carriage 22 drives the multi-channel pipetting head 12 to aspirate and dispense. As described in more detail below, a Z-axis drive mechanism moves the carriage 22 and the multi-channel pipetting 12 vertically with respect to the tower 24 and the deck 16. An X-axis drive mechanism moves the tower 24 and the carriage 22 horizontally along an X-axis so that the pipetting head 12 and the array of tips 14 can be moved from a position corresponding to the wellplate 26 in the first nesting receptacle 18 on the deck 16 to positions corresponding to the wellplate 28 residing in the left side nesting receptacle 20.

The system 10 includes a control handle 30 preferably mounted to the carriage 22 and as mentioned previously and preferably resembles a handle for a handheld electronic pipettor. More specifically, the control handle 30 is preferably mounted to a load cell 32 that is attached to the carriage 22. In use, the user grasps the control handle 30 in the manner similar as when using a handheld pipettor, and exerts pressure on the control handle 30 to move the carriage 22 and the pipetting head 12. The vertical Z-axis motion and the horizontal X-axis motion are driven by independent motors under servo control as is explained below. The control handle 30 also preferably includes a user interface for controlling pipetting functions such as aspirating and dispensing as is also discussed in more detail below.

As mentioned, the use of the controller 30 as well as the overall operation of the system 10 is intended to replicate the natural hand motion of a user using a conventional handheld pipettor. However, with a conventional handheld pipettor, a user would not be able to reliably use a 96-channel pipetting head because of alignment and weight issues. It would be extremely difficult to properly align all 96-pipette tips with a detached handheld pipettor. Both linear alignment and angular alignment errors would make such a system impractical. Moreover, such a system would be relatively heavy, perhaps 5-10 lbs., which is also impractical. The manually directed, multi-channel electronic pipetting system 10 illustrated in FIGS. 1-14, provides reliable mechanical alignment of the pipette tips 14, and also isolates the user from the actual weight of the pipettor.

The carriage 22 and tower 24 mechanically support the pipetting head 12 and allow movement of the pipetting head 12 along the vertical Z-axis and the horizontal X-axis, but prevent unwanted Y-axis motion or rotation. Other mechanical arrangements could be used in accordance with the invention to support and move the pipetting head in a similar fashion, such as a gantry system, although the tower 24 and carriage 22 mechanism have been found to be practical.

Figure 4:
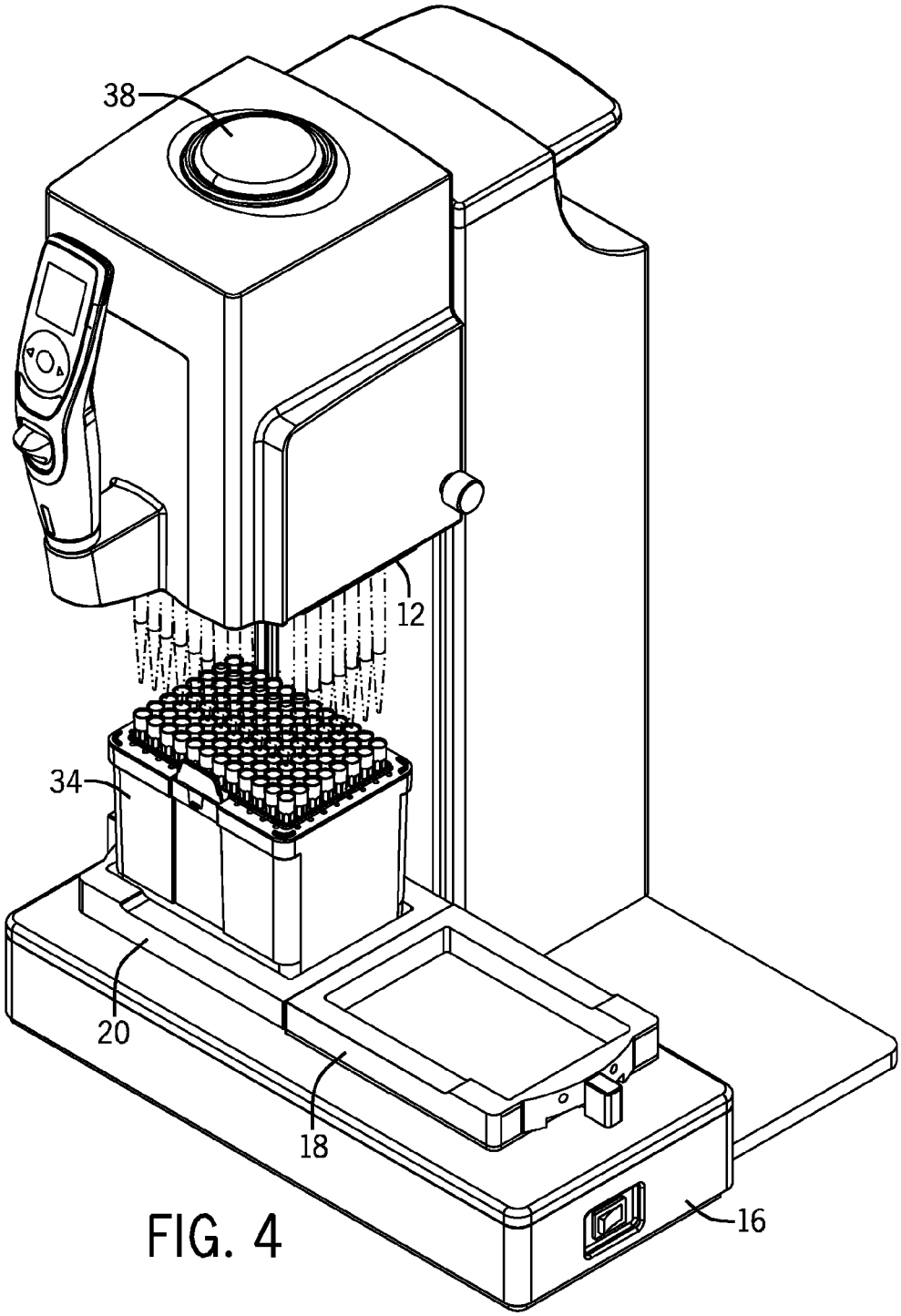
FIG. 4 is a view similar to FIG. 1 illustrating tip attachment.

The manually directed, multi-channel electronic pipetting system 10 must not only be capable of transferring fluids from and to selected locations, but must also provide for the practical and convenient attachment and ejection of the pipette tips. FIG. 4 illustrates a box 34 of pipette tips located on the right side nesting receptacle 18 ready for attachment to the pipetting head 12. The preferred pipetting head includes an array of 96-tip fittings, see e.g. reference number 36 in FIG. 6. However, other ways known in the art to mount tips can be used in accordance with the invention, such as using the magazine. The preferred tip attachment and ejection mechanism is disclosed in detail in patent application entitled "Unintended Motion Control for Manually Directed Multi-Well Electronic Pipettor" filed on even date herewith by Julian Warhurst and Richard Cote, claiming priority to U.S. Provisional Patent Application No. 61/330,545, filed on May 3, 2010, now U.S. patent application Ser. No. 13/099,953, filed May 3, 2011, Publication No. US 2011/0268628, published Nov. 3, 2011, assigned to the assignee of the present application and incorporated herein by reference. Briefly, the pipetting head 12 with the array of tip fittings 36 is aligned precisely over the tip container 34 using the X-axis horizontal driven mechanism. Then, the Z-axis vertical drive mechanism is used to lower the carriage 22 and the tip fittings 36 with sufficient force to attach the array of pipette tips 14. The carriage 22 and the pipetting head 12 are then raised using the Z-axis horizontal vertical drive mechanism to remove the tips 14 from the tip container 34. The tip container 34 is removed from the nested receptacle 18 and replaced with a wellplate or reservoir in order to transfer fluids. For tip attachment as with regular motion control, the general horizontal and vertical motion of the carriage 22 and pipetting head 12 is controlled by the user by holding the controller 30 in their palm and applying pressure in the appropriate direction to position the pipetting head 12 over the tray 34 of pipette tips 14. Precise alignment necessary for tip attachment would of course be quite difficult; however, motion control software facilitates precise alignment.

Electromechanical and software controls motion of the pipetting head and smooth operation, foster precise alignment, and control force exerted by the drive systems, etc. General aspects of the motion control system are described below in connection with FIG. 14. Preferably, biasing software as disclosed in patent application "Pipette Tip Positioning for Manually-Directed, Multi-Channel Electronic Pipettor", by Julian Warhurst, filed on even date herewith, claiming priority to U.S. Provisional Patent Application No. 61/330,551, filed on May 3, 2010, now U.S. patent application Ser. No. 13/099,854, filed May 3, 2011, Publication No. US 2011/

0296931, published Dec. 8, 2011, and assigned to the assignee of the present application and incorporated herein by reference is used to facilitate appropriate horizontal alignment of the pipetting head 12 for tip attachment. In addition, the system 10 also preferably includes software checks to assure proper alignment of the pipetting head before implementing tip attachment functions, as disclosed in the above incorporated patent application entitled "Unintended Motion Control for Manually Directed Multi-Channel Electronic Pipettor". Briefly, the amount of downward force necessary for tip attachment is substantially greater than the amount of downward force desirable during normal operation. Allowing pipette tips to crash into well-plates with too much force can cause damage, as well as loss of reagents and samples and the like. The system 10 preferably includes a tip attach button 38 on top of the carriage 22 which must be depressed in order for the system 10 to exert sufficient downward vertical force for tip attachment. For example, the user will depress a button 38 with their left hand and hold the controller 30 in their right hand and push down on the controller 30 in order to move the carriage 22 downward to attach the tips to the pipetting head 12. The tip attachment button 38 need not be located on the top of the carriage 22, although it is desirable to occupy both hands of the user for safety purposes. For example, it may be desirable to place the tip attachment button 38 at a different location on the system 10, or on the surface of the laboratory workbench.

Figure 5:
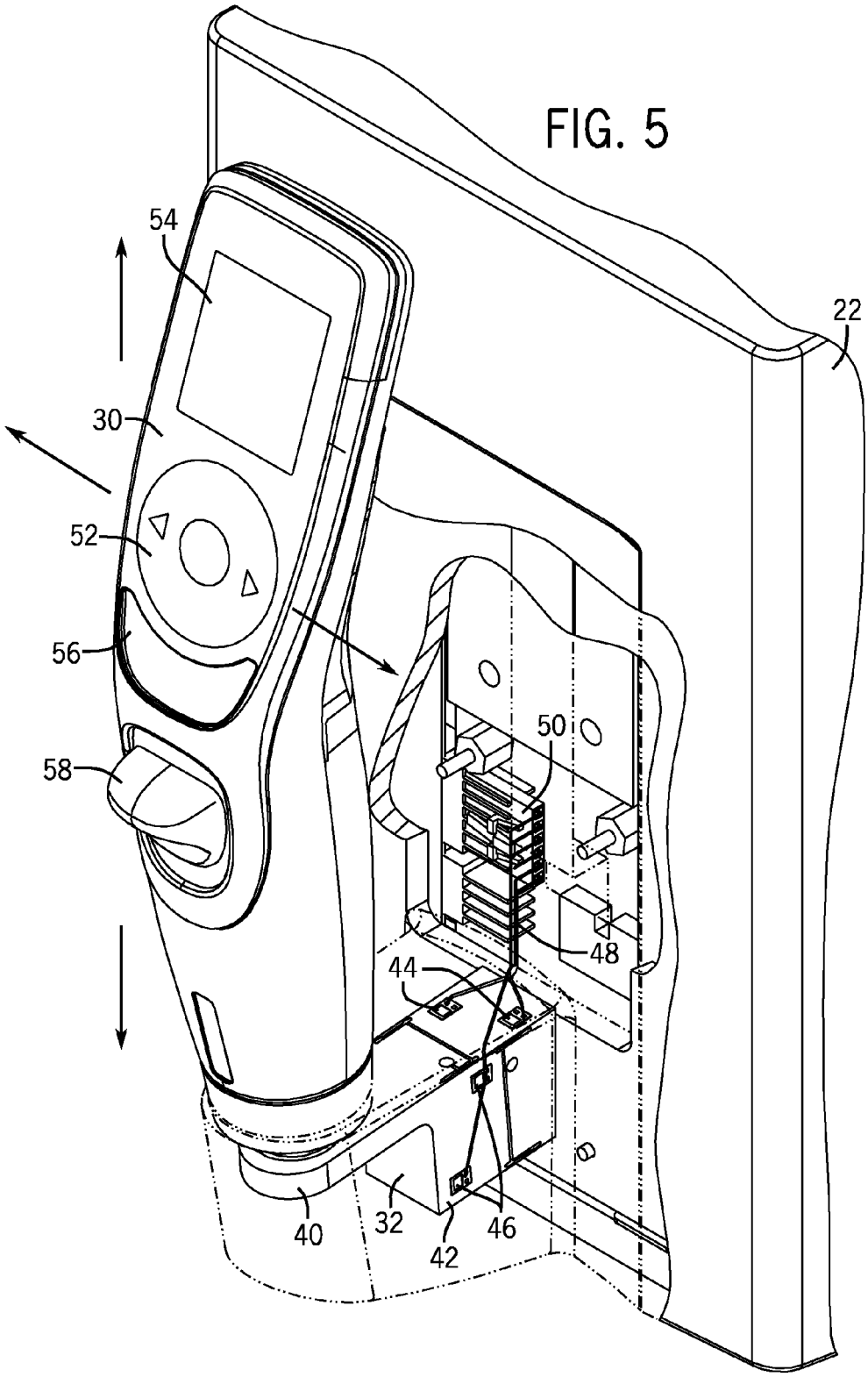
FIG. 5 is a view of the control handle and its attachment to a load cell and carriage in manually directed, multi-channel electronic pipetting system shown in FIGS. 1-4.
Figure 14:
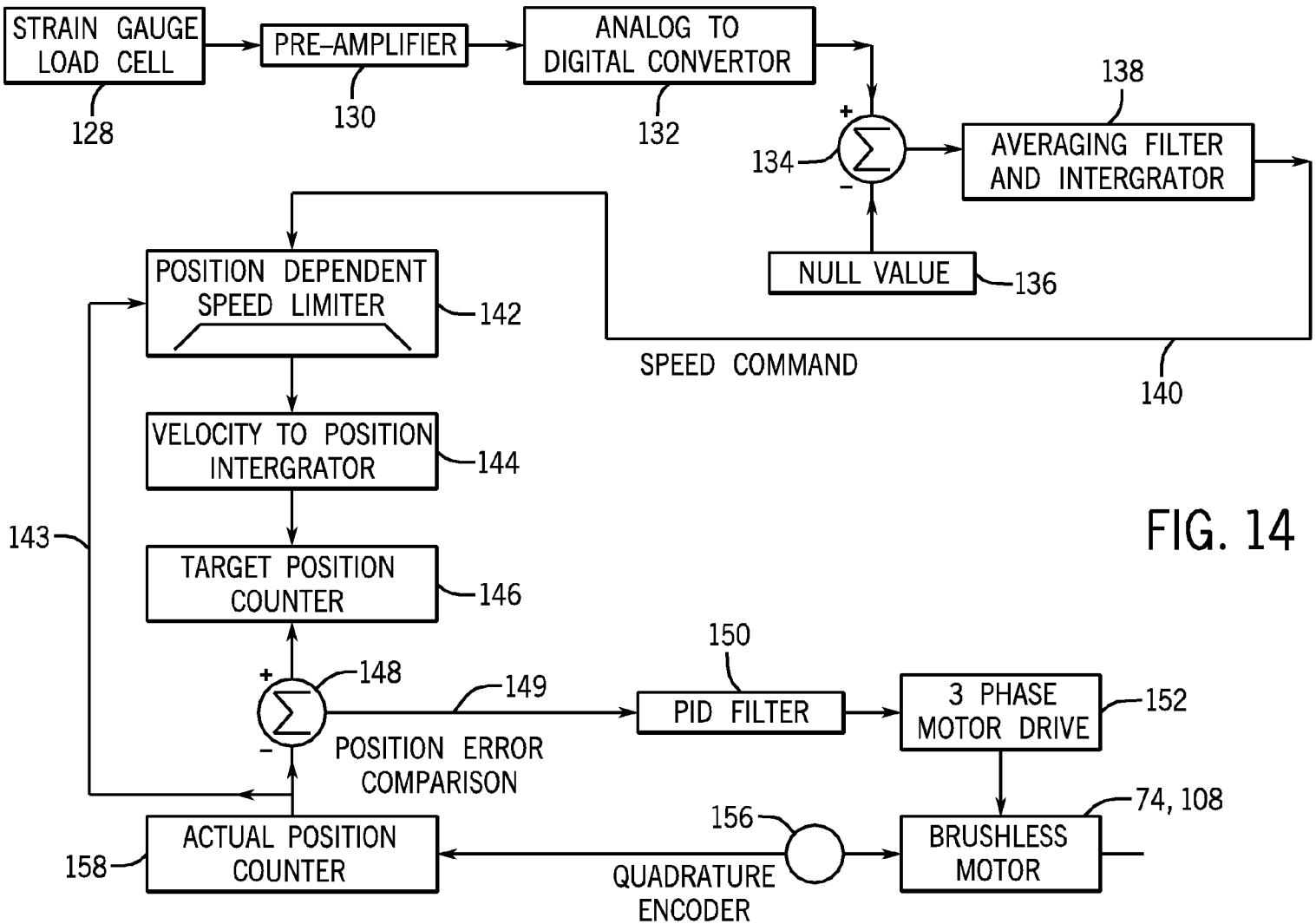
FIG. 14 is a block diagram illustrating electromechanical and software control loop used in accordance with one embodiment of the invention.

After samples and/or reagents have been pipetted, the tips are typically ejected into a tip tray 34 or loosely into a bin. Referring now to FIG. 5, the control handle 30 is attached to a cantilever 40 on the load cell 32. The cantilever 40 extends generally horizontally forward from a base 42 of the load cell 32 that is attached to the frame of the carriage 22. A pair of strain gauges 44 is attached to a top surface of the load cell base 42. This pair 44 of strain gauges is used to detect the amount of force or pressure applied by the control handle 30 on the load cell 32 in the X-axis horizontal direction. Another pair of strain gauges 46 is attached to a sidewall of the base 42 of the load cell 32. This pair of strain gauges 46 is used to detect the amount of force or pressure that the control handle 30 exerts in the vertical Z-axis direction on the load cell 32. The X-axis drive and the Z-axis drive operate independently and contemporaneously when a component of force input is measured by each respective pair of strain gauges 46. Electrical leads 48 connect the strain gauges 44, 46 to input terminals 50 located within the carriage 22. The terminals 50 provide electrical connection to the motion control system which is schematically illustrated in FIG. 14, and are preferably located on a printed circuit board within the carriage 22.

As mentioned, the preferred control handle 30 is the same or quite similar to that disclosed in issued U.S. Pat. No. 7,540,205 entitled "Electronic Pipettor" by Gary Nelson et al. issued on Jun. 2, 2009, which is incorporated herein by reference. The preferred control handle 30 not only provides a handle for attachment to the load cell 32 to control movement of the pipetting head, but also preferably provides a user input interface. The control handle 30 shown in FIG. 5 includes an elongated body adapted to be held in the hand of the user. A touch wheel control 52 is designed to be operated by the user's thumb. The touch wheel control 52 is located below a dot matrix user interface display 54. The preferred controller 30 also includes a run button 56 which is located below the touch wheel control 52 and an ejector button 58. In this exemplary embodiment, a printed circuit board with a dedicated microprocessor is located within the control handle 30, although the tower 24 contains a larger main printed circuit board containing several mounted electronic components including an additional main microprocessor. The circular touchpad 52 translates rotational movement of the user's thumb (or finger) into cursor movements on the display 54 in order to navigate menu driven software. The menu driven software is, in many respects, similar to the software disclosed in application entitled "Pipettor Software Interface", application Ser. No. 11/856,232 by George Kalmakis et al., filed Sep. 17, 2007, now U.S. Pat. No. 8,033,188 issued Oct. 11, 2011, assigned to the assignee of the present application and incorporated herein by reference. As mentioned previously, the software provides graphic displays for adjusting volume, relative pipetting speed, pace and count for the various program pipetting procedures. The software also preferably provides multiple programmable pipetting modes based on predetermined algorithms, such as pipette, repeat pipette, sample dilute, pipette/mix, manual pipette, reverse pipette, variable dispense, variable aspirate, sample dilute/mix, and serial dilution. These functional modes are based upon predetermined algorithms embedded in the software to implement respective, well known pipetting procedures, although various parameters such as volume, speed, pace, count, direction and mixing are available for programming and editing for the user. In addition, the preferred software also includes a custom programming mode in which the user can create custom pipetting procedures based on the steps of aspirating, mixing, dispensing and purging. The preferred software also includes other features as well.

While the touch wheel control 52 and the display 54 are generally used to program the pipetting system, the display 54 is also used to show progress or status during an implemented pipetting routine. In this regard, the run button 56 is used to activate the system to aspirate or dispense, etc. in accordance with the pipetting protocol on the display 54. For example, consider a situation in which the pipette tips 14 are attached to the pipetting head 12 ready for use and a reagent reservoir is placed within nested receptacle 18 and a wellplate with samples is placed in nested receptacle 20, and it is desirable in accordance with a programmed protocol to transfer 20 ml of the reagent from the reservoir into each of the 96-wells in the well-plate. The user grasping the control handle 30 will first direct the carriage 22, pipetting head 12 and pipette tips 14 over the reservoir located in nesting receptacle 18. The display 54 may illustrate an instruction such as "aspirate 20 ml". The user will then lower the pipette tips 14 into the liquid in the reservoir by placing downward pressure on the control handle 30. Then, in order to aspirate 20 ml of the reagent into each pipette tip 14, the user will press run button 56 to activate the pipetting stepper motor to aspirate 20 ml of reagent into each pipette tip. The user will then lift the filled pipette tips 14 from the reagent reservoir in the first nesting receptacle 18 by pulling upward on the control handle 30. The next instruction on the display 54 may be "dispense 20 ml". The user will then move the filled pipette tips over the wellplate in the second nesting receptacle 20, and align the pipette tips over the appropriate wells in the wellplate by pressing against the control handle 30. The user will then lower the filled tips over the wells, and presses run button 56 to instruct the pipettor stepper motor to dispense the liquid in the pipette tips.

Figure 6:
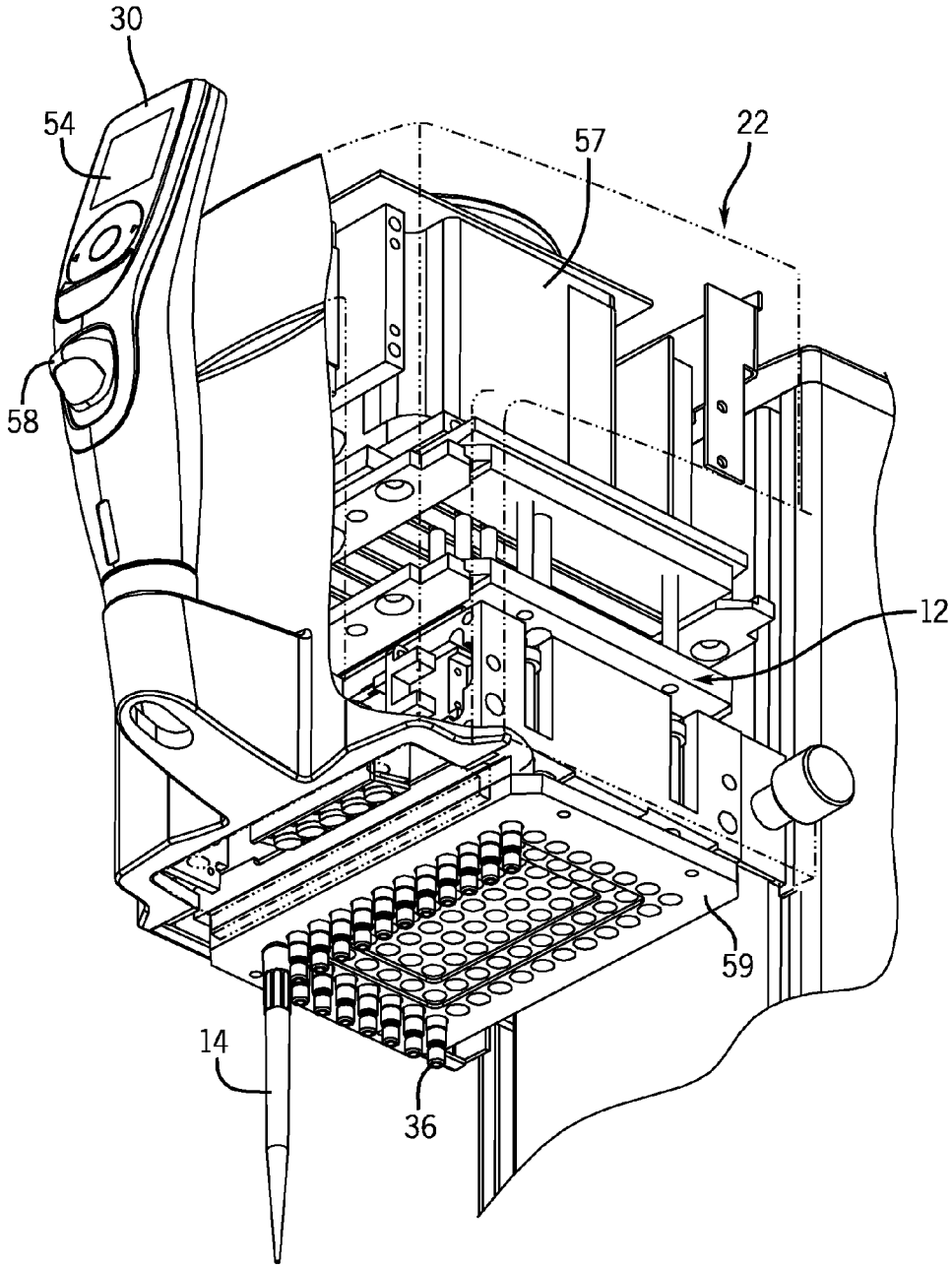
FIG. 6 is a lower perspective view of the pipetting head and pipetting motor a view of the manually directed, multi-channel electronic pipetting system shown in FIGS. 1-5.

Referring to FIG. 6, a stepper motor 57 drives an array of pistons in the pipetting head 12 to aspirate and dispense. The invention is not limited to the type of pipetting motor and accompanying multi-channel manifold as systems other than the type shown can be used in accordance with the invention. Preferably, the pipetting motor is an electronically controlled stepper motor similar to that disclosed in co-pending U.S. Pat. No. 7,540,205, assigned to the assignee of the present application and incorporated herein by reference. It is desirable that the pipetting head 12 be removable in order to accommodate the use of different sized pipette tips 14. In the exemplary embodiment shown in FIG. 6, the carriage 22 includes longitudinal wedge surfaces for securing the removable pipetting head 12 to the carriage 22. A sensor is provided to signal to the system when a pipetting head 12 has been fully installed. The system further allows the user to set a lateral offset position for the removable pipetting head 12 with respect to the wellplate nesting receptacles 18, 20 on the deck 16.

As mentioned, the ejector button 58 is located on the control handle 30. A sensor in the control handle 30 detects whether the ejector button 58 has been activated. If so, a signal is relayed to the main electronic control system to activate an automated tip stripping procedure. It is desirable that the menu-driven software displayed on a user interface 54 on the control handle 30 provide an ejection confirmation inquiry after the ejector button 58 has been activated but prior to transmitting the control signal to strip the pipette tips 14. The same motor 57 responsible for moving the pistons on the pipetting head 12 to aspirate and dispense is driven into an over-extended condition in order to move a stepped stripping plate 59 to eject the disposable pipette tips 14 from the tip fittings 36. The use of the stepped stripping plate 59 enables groups of tips 14 to be sequentially removed from the tip fittings 36, thereby reducing the instantaneous torque load on the motor 57.

Figure 7:
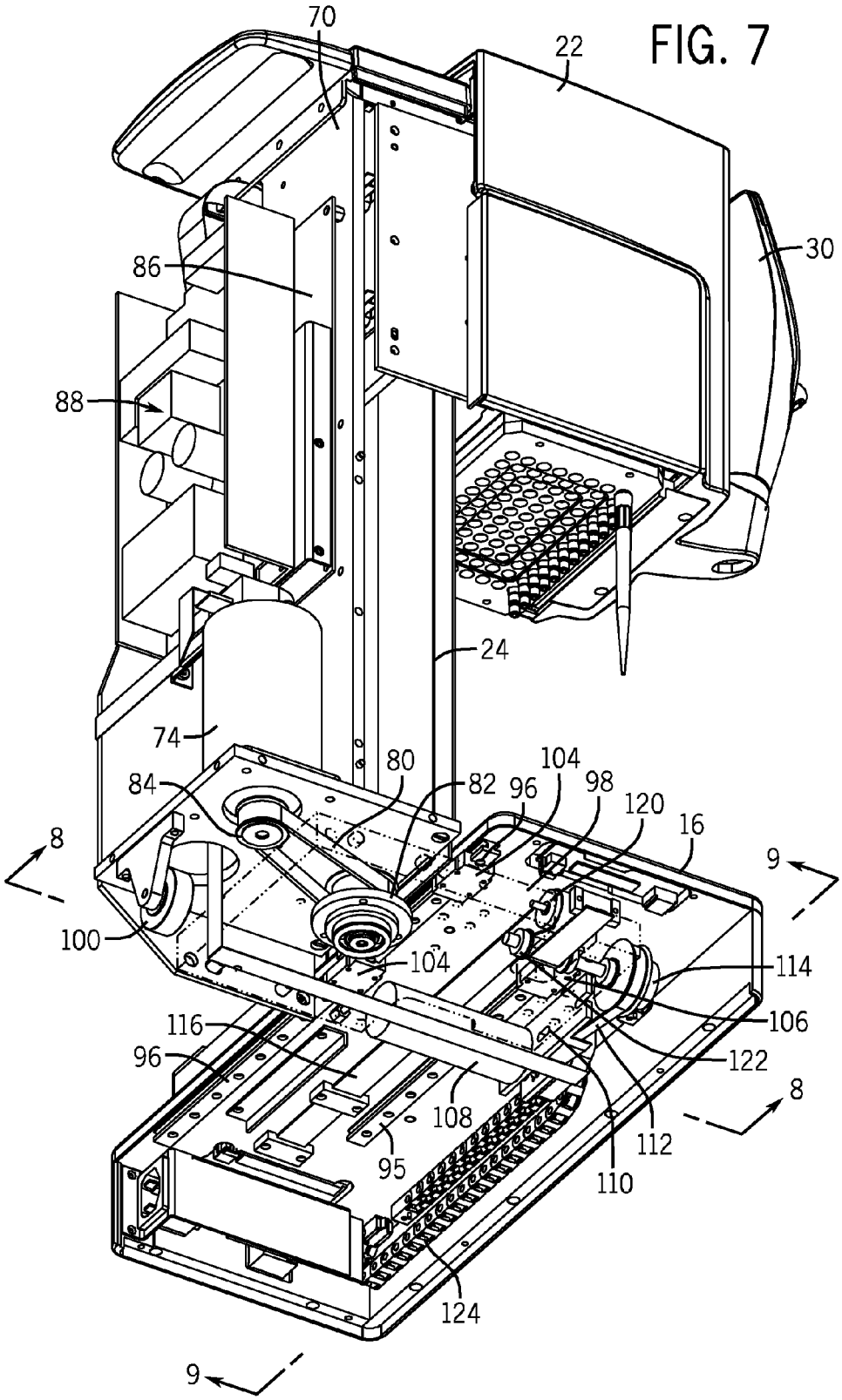
FIG. 7 is a rear lower perspective view illustrating internal components of the manually directed electronic multi-channel pipetting system illustrated in FIGS. 1-6.

Referring now FIG. 7, the Z-axis vertical drive mechanism is located within the tower 24 and the X-axis vertical drive mechanism is located within the deck 16. Each is independent, and driven by motors under servo control. The preferred Z-axis vertical drive uses a lead screw which is driven through a single stage pulley reduction. The X-axis horizontal drive uses a belt drive which again is driven through single stage pulley reduction. A printed circuit board 86 and accompanying electronics 88 are mounted to vertical support plate 70.

Figure 11:
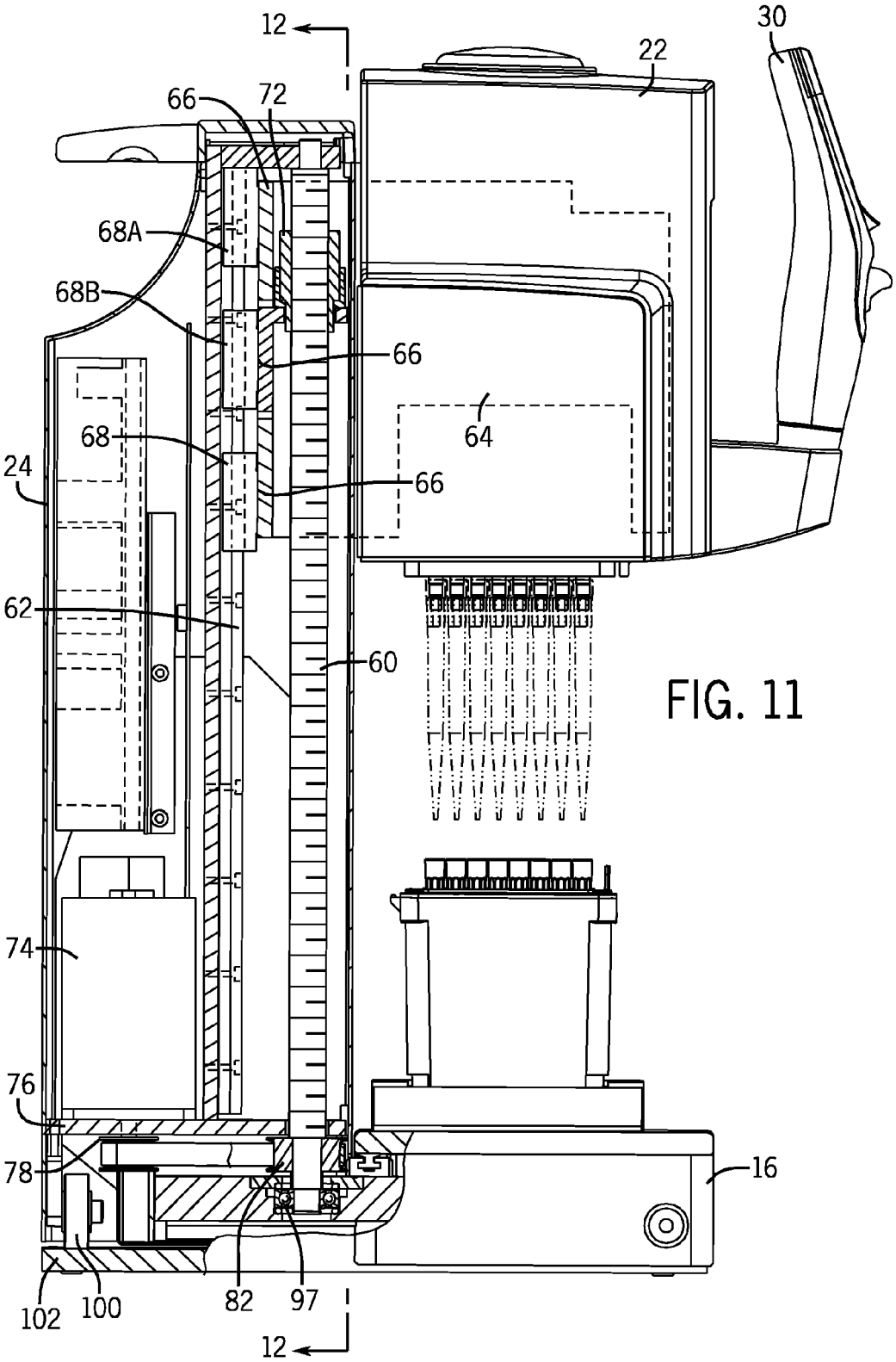
FIG. 11 is a side elevational view schematically illustrating the Z-axis vertical drive mechanism in the tower.
Figure 12:
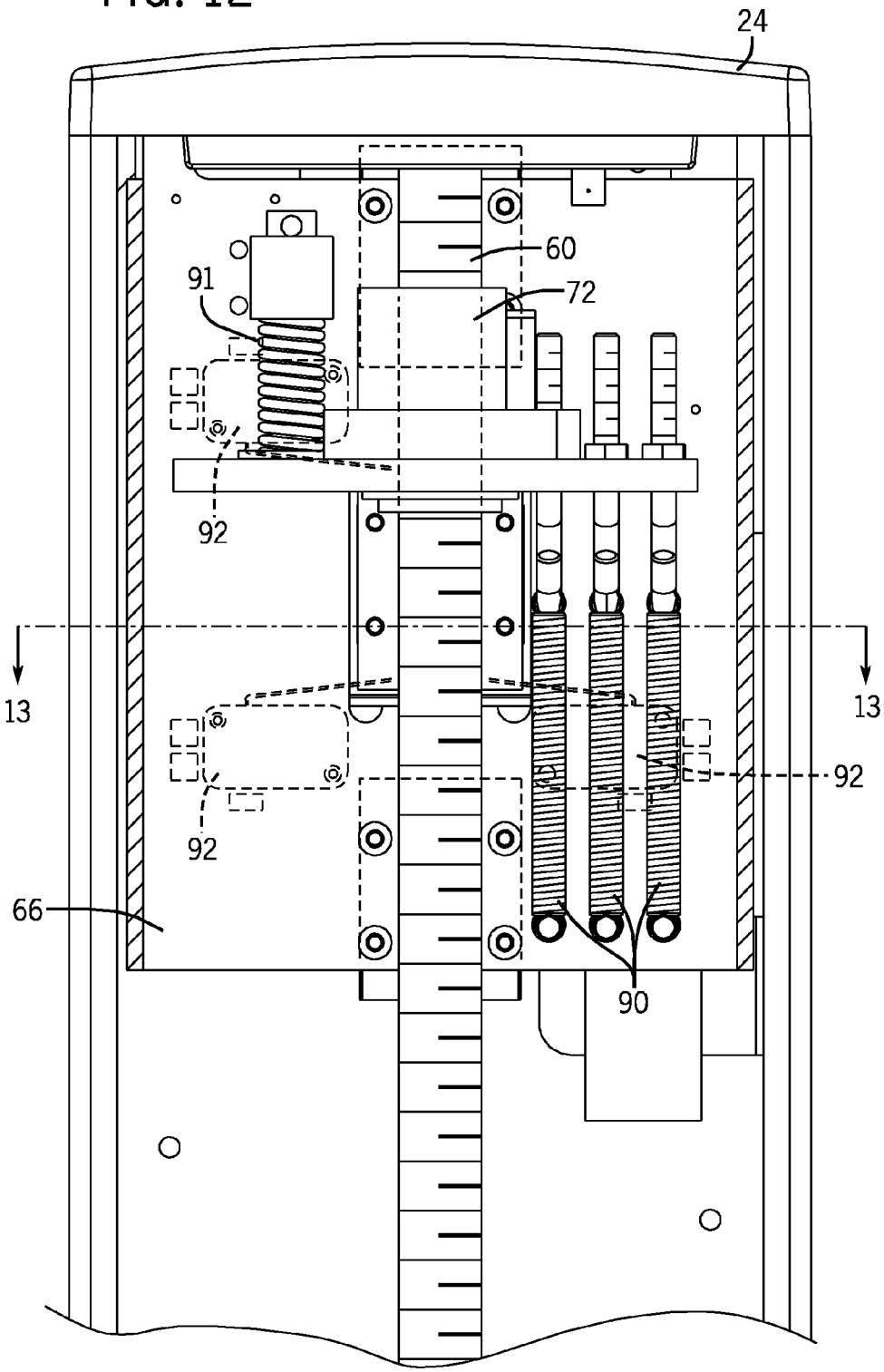
FIG. 12 is a detailed view taken along line 12-12 in FIG. 11.
Figure 13:
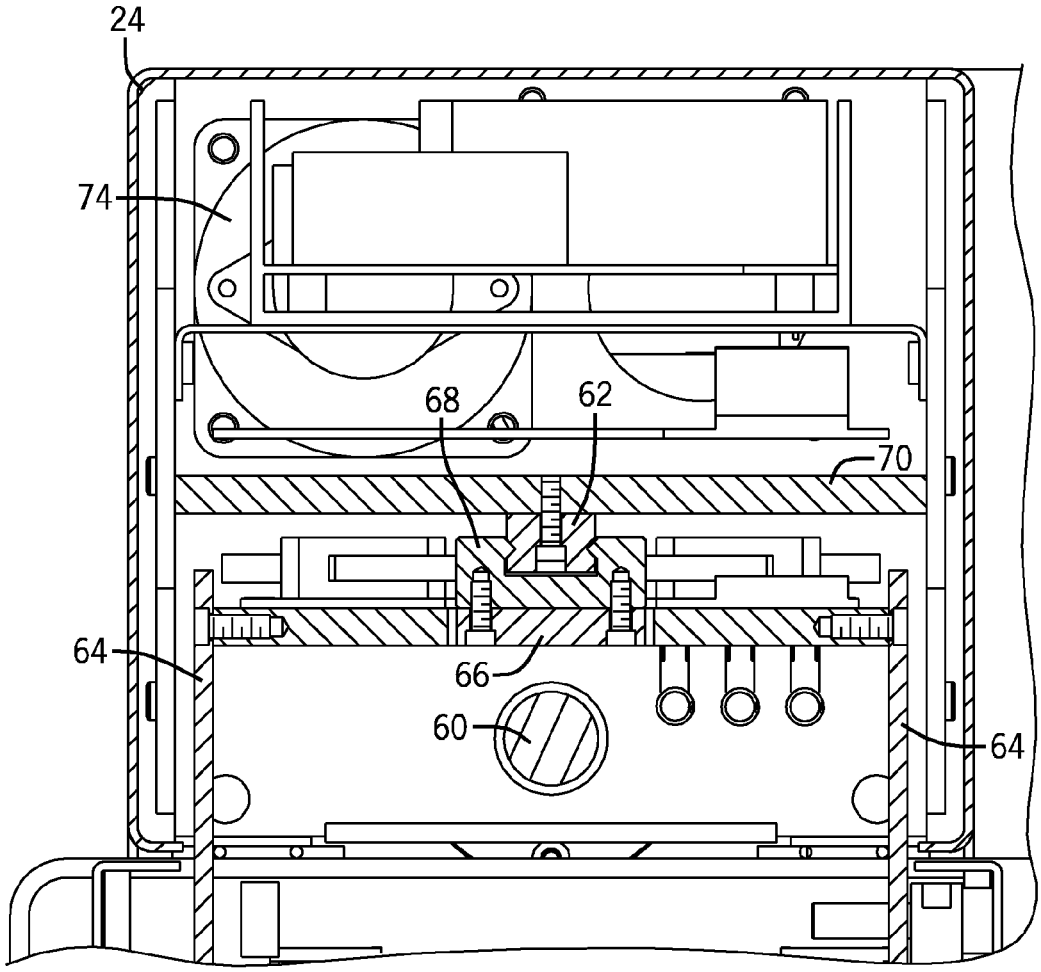
FIG. 13 is a detailed view taken along line 13-13 in FIG. 12.

Referring now also to FIGS. 11-13, the Z-axis vertical drive mechanism includes a vertically mounted lead screw 60 in the tower 24. A vertical guide rail 62 is also mounted vertically in the tower 24 and generally in parallel with the lead screw 60. Mounting plates 64 from the carriage 22 extend into the tower 24. Cross plates 66 span between the carriage mounting plates 64. Slidable support bushings 68 journaled to the vertical guide rail 62 are connected to the cross plate 66. The position of the guide rail 62 is stabilized by attachment to plate 70 in the tower 24. A threaded follower 72 is seated on the lead screw 60. The follower 72 is attached to the cross plates 66, which in turn are attached to bushings 68A and 68B on the vertical rail 62. Servo motor 74 is mounted on base plate 76 in the tower 24, see FIG. 11. Servo motor 74 drives pulley 78, and in turn through belt drive 80 drives pulley 82, which is connected to lead screw 60. When the servo motor 74 is activated to turn lead screw 60, the follower 72 and hence the carriage 22 moves vertically up or down depending on the direction of rotation of the lead screw 60.

As best shown in FIG. 12, it may be desirable to connect vibration dampening springs 90 to the cross plates 66 to which the follower 72 is mounted. In any event, the system 10 preferably includes trip switches 92 and spring 91 which are used to limit the amount of vertical force that can be applied by the Z-axis vertical screw drive. FIG. 12 shows only one spring 91 on one side of the lead screw 60, but it may be preferred to include another spring 91 on the other side of lead screw 60 in order to balance the load when limiting the amount of vertical force that can be applied by the Z-axis vertical screw drive. This aspect of the operation is described in detail in co-pending patent application Ser. No. 13/099,953, filed on even date herewith, Publication No. US 2011/0268628, published Nov. 3, 2011, entitled "Unintended Motion Control for Manually Directed Multi-Channel Electronic Pipettor", by Julian Warhurst and Richard Cote. In general, if the force exerted by the Z-axis drive exceeds the threshold spring force for spring 91 (or pair of springs 91), the distance between the upper and lower trip switches 92 will not coordinate and the control system will disable further Z-axis motion in the desired direction. Motion will, however, preferably be allowed in the reverse direction.

Figure 8:
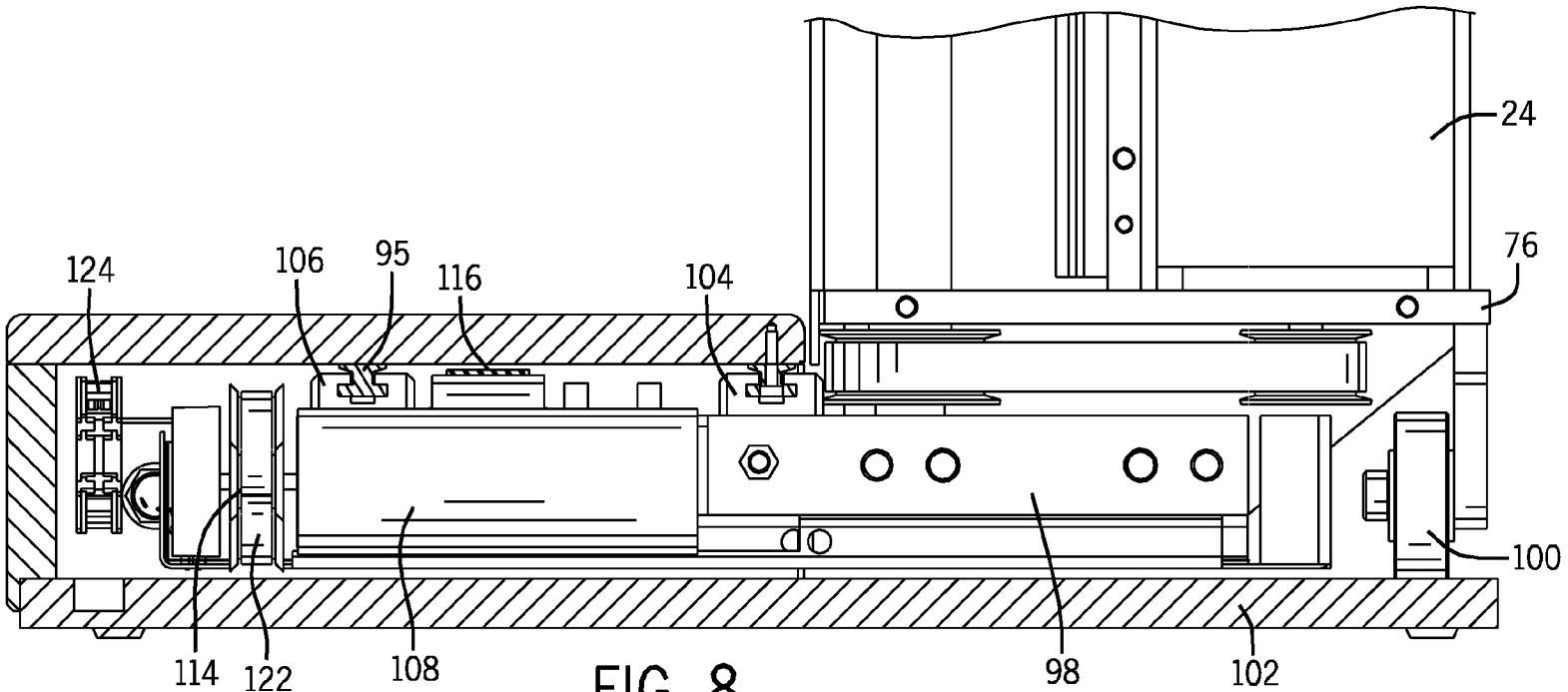
FIG. 8 is a view taken along line 8-8 in FIG. 7.

Referring now in particular to FIGS. 7, 8 and 11, the bottom of the lead screw 60 is mounted in a bearing 97 located on a horizontally movable support block 98. The horizontally movable support block 98 is moved by the X-axis horizontal drive mechanism. Block 98 is shown in phantom in FIG. 7. The tower 24 is also supported for horizontal movement via wheel 100, which rolls on bottom plate 102. The wheel 100 is mounted to a tower base plate 76. Alternatively, the tower 24 can be supported for horizontal movement by a bearing or rail mechanism. In this arrangement, a horizontal guide rail would be attached to the bottom plate 102.

For the horizontal drive mechanism, horizontal guide rails 96 and 95 are mounted to the top plate of the deck 16. Alternatively, horizontal guide rails can be attached to the bottom plate 102. Referring again to FIGS. 7, 8 and 11, slidable bushings 104, 106 for the rails 96, 95 are attached to the horizontally movable support 98. Servo motor 108 is mounted to a plate 110 that is mounted to the horizontally movable support 98. The servo motor 108 as well as its pulley drive mechanism move horizontally with the movable support 98 and the tower 24. Belt 112 connects the output of the servo motor 108 to pulley 114, see FIG. 7. The mechanical output from pulley 114 in turn drives a belt drive mechanism 116. The belt 116 is attached to the surface of the deck 16. The belt 116 is also threaded around a pair of rollers 120, 122 for the belt drive on the horizontally movable support 98. Roller 122 is driven by the output from pulley 114 that is driven by the belt 112 connected to the servo motor 108. Electrical energy is supplied to the servo motor 108 via linked electrical connector 124.

Figure 9:
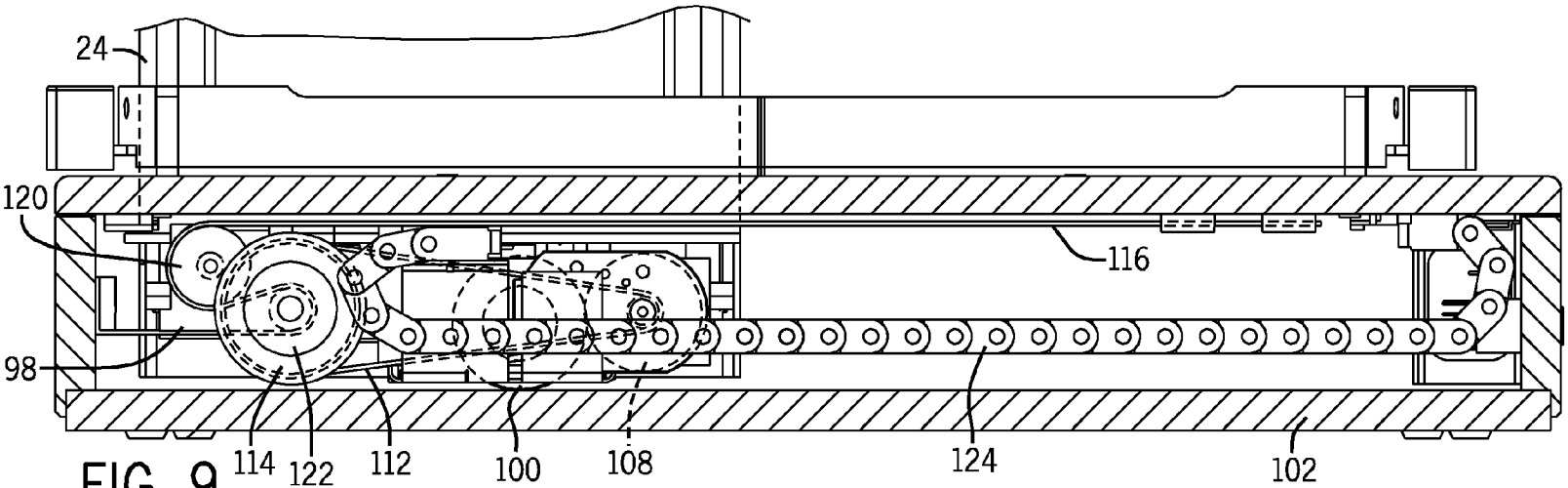
FIG. 9 is a sectional view taken along line 9-9 in FIG. 7.
Figure 10:
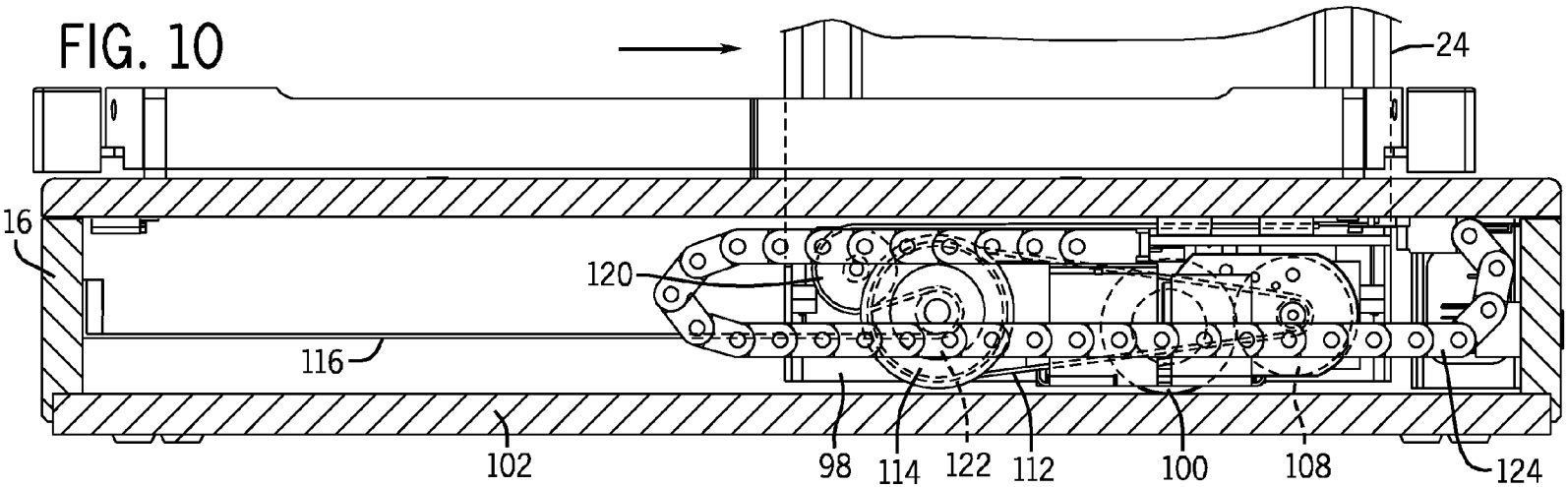
FIG. 10 is a view similar to FIG. 9 illustrating the tower in the right hand side receptacle position.

Referring to FIGS. 9 and 10, when the servo motor 108 drives roller 122 of the belt drive, the horizontally movable support 98 and the tower 24 move horizontally. As mentioned, the horizontal movement is guided by horizontal guides 95, 96 as shown in FIGS. 8 and 7.

The servo motor 108 for horizontal movement and the servo motor 74 for vertical movement are preferably brushless 3-phase motors with encoders operated with identical and independent control loops. Both vertical motion and horizontal motion can operate simultaneously depending on the force imparted on the control handle 30. FIG. 14 illustrates the preferred control loop when the user imparts a force on the control handle 30, the horizontal component of the force as well as the vertical component force will be detected by strain gauge pairs 44, 46 as illustrated by reference number 128 in FIG. 14. The output of the load cell is a microvolt level signal that is initially amplified by a pre-amplifier 130 to a level suitable for A/D conversion. The voltage signal from the pre-amplifier 130 is converted into a digital force value preferably at a rate of 100 samples/second. The digital output signal form the A/D converter 132 is then null corrected, reference number 134. The null correction feature allows the load cell output to drift over time and/or have poor initial zero output. To determine the null value 136, the user is asked to remove their hand from the control handle 30, the A/D converter output 132 is then measured, and if stable that value it is stored as the null value 136. During normal operation, the null value is subtracted from the A/D converter output 132 and the output of the null subtraction 134 is in the range of +127 to −127 (2×108) with zero corresponding to no input from the user. The null correction feature is useful when the load cell 32 is overloaded due to misuse or accidental impact which may cause its "zero" value to change. Preferably, the null value will be reset whenever the system is re-initialized.

The null-corrected user force value is then passed through an averaging filter and integrator 138. The averaging filter and integrator 138 has two functions. First, since the load cell is subject to some vibration and noise during normal operation, the averaging filter 138 smoothes out the signal. Second, the integrator reduces the force that the user must impart by accumulating the force input over time. This provides the handheld controller 30 with a light feel and imparts a sensation of inertia which has been found to be desirable. The output from the averaging filter and integrator 138 is the requested speed value, line 140. The requested speed value is a speed limiting function, which is designated in FIG. 14 as block 142. The purpose of the speed limiting function 142 is to prevent crashing in the either vertical or horizontal direction at the end of the travel range. Crashing may cause damage, and also provides undesirable sensation. The requested speed value 140 is limited at the end of the mechanical travel range such that the speed is linearly reduced to zero as the end of the mechanical travel range is reached. To do this, the speed limiter 142 is updated with the actual position of the pipetting head from the encoder 156 and position counter 158 for the respective motor 74, 108. Line 143 illustrates the actual position data being fed back to the speed limiter 142. For the horizontal axis, the total travel is approximately 150 mm with the speed limiter coming into effect during the last 10 mm on either end of travel. For the vertical axis, the total travel is approximately 25 mm. The distance in which the limiter comes into effect depends on the size of pipette tips 14 that are being used.

The adjusted speed value from the speed limiter 142 is then integrated, e.g. at a rate of 1 kHz, to calculate a target position, see reference numbers 144 and 146. The target position is updated, e.g. 1,000 times/second, and represents the position that the respective servo motor 74, 108 should attempt to achieve, i.e. the classic target position for an industry standard PID controller.

The actual motor position is measured by accumulating the output of the digital encoder 156 attached to the respective servo motor 74, 108, see reference number 158. The actual position is then compared to the target position, see reference number 148, and the output is a position error value in line 149. The position error value in line 149 is passed through a proportional-integral-derivative filter 150, which calculates the desired motor output power. The desired motor output power signal is then fed to a 3-phase motor driver 152 which converts the signal to a pulse width modulation signal that is amplified through a 3-phase FET bridge and then fed to the servo motor 74, 108.

The result of this control loop is that the motion of the pipettor head 112 tracks the hand motion imparted by the user on the control handle 30, with a natural feel and with end travel limits imposed in a gradual matter. Further, the system is tolerant of changes in load cell characteristics over time.

Figure 15:
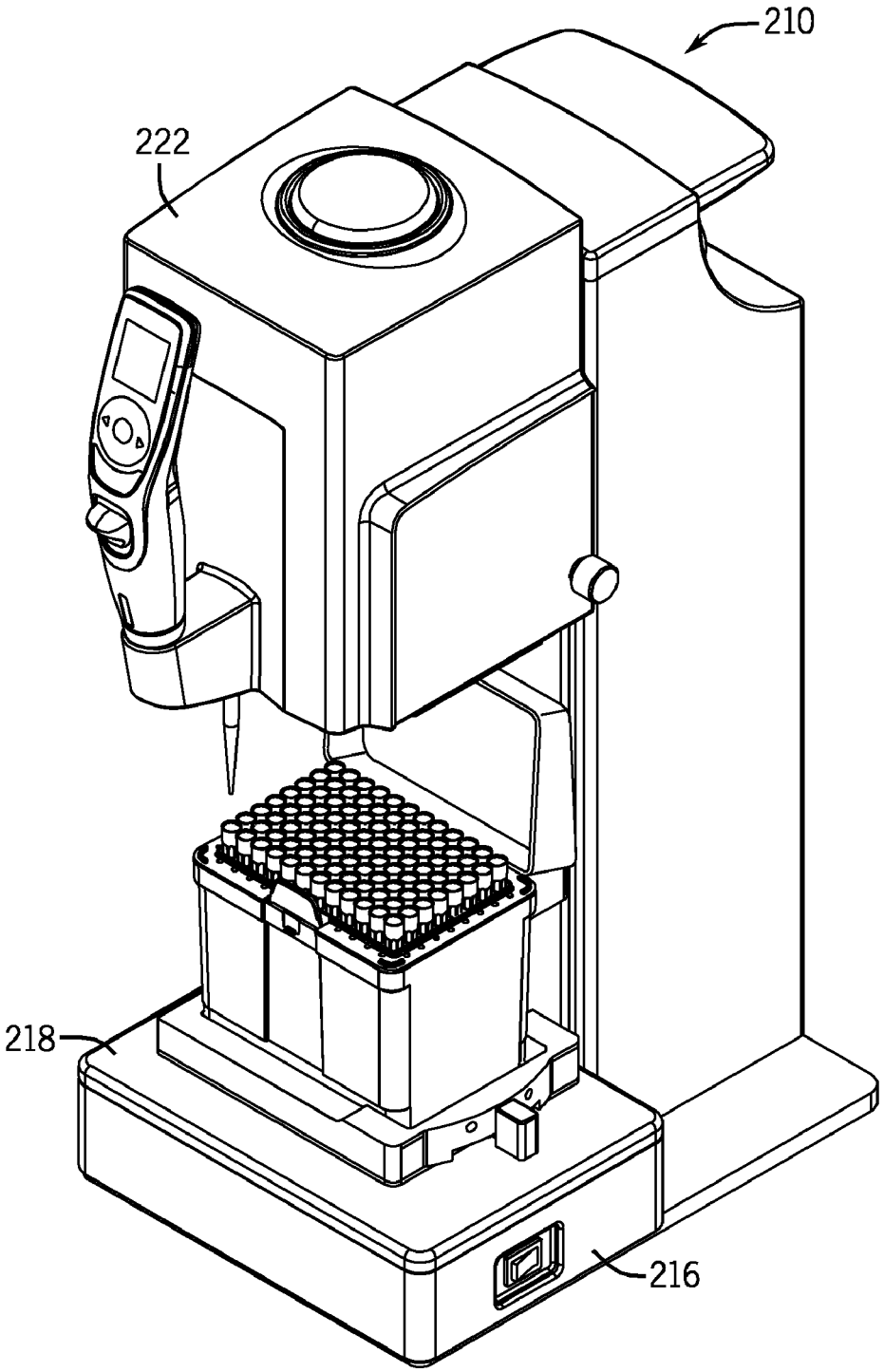
FIG. 15 illustrates another embodiment of the invention in which the manually directed, multi-channel electronic pipetting system is designed to hold only one multi-well plate or reservoir on the deck.

While the exemplary embodiment of the invention illustrates the use of a vertical Z-axis linear drive and a horizontal X-axis horizontal drive mechanism, as mentioned, other configurations can be used to implement the invention, such as use of a rotor drive mechanism for horizontal movement. FIG. 15 illustrates another embodiment 210 which is similar to the embodiment described in FIGS. 1-14 but only provides for vertical movement of the carriage 222. Note that the deck 216 in this embodiment includes only one nesting receptacle 218 so that the user needs to place and remove individual well-plates, reservoirs and tip containers while implementing liquid transfer protocol.

In another embodiment similar to that in FIG. 15, the lateral position of the deck with respect to the pipetting head can be moved manually. In yet another embodiment of the invention, the system can include a horizontal Y-axis drive mechanism that is responsive to the control handle similar to the X-axis horizontal drive mechanism. In such embodiment, it is preferred that the carriage for the pipetting head be mounted on a gantry rather than a tower. One advantage of such an embodiment would be to allow the system to access two or more rows of well-plates on the deck. Another advantage is that it would allow motorized, accurate positioning of the pipette tips in the Y-axis direction which is helpful when dispensing into 384-well plates.

It should be noted that in the exemplary embodiments the force or movement of the control handle 30 is detected using a load cell, it is possible within the spirit of the invention to use other detectors to detect pressure, force or movement of the control handle 30 such as potentiometers, optical sensors or laser sensors. Further, it may be desirable in some circumstances to manually implement relative vertical and horizontal movement of the carriage 22 and pipetting head 12 with respect to the deck 16, or manually implement relative vertical movement only. In such an embodiment of the invention, the pipetting functions would be electronic as described previously and preferably controlled via user interface on a control handle 30 as depicted in connection with the other embodiments of the invention.

What is claimed is:

1. An electronic multi-channel pipetting system comprising:

a multi-channel pipetting head having a plurality of pipetting channels arranged in a two-dimensional array of rows and columns;

a pipetting motor that drives the multi-channel pipetting head to aspirate and dispense;

a deck for holding at least one multi-well plate, tube rack or reservoir, said at least one multi-well plate having a plurality of wells arranged in a two-dimensional array of rows and columns; and a drive mechanism having at least one motor for moving the multi-channel pipetting head with respect to the deck;

a control handle that is operated by a user of the electronic multi-channel pipetting system;

an electronic motion control system for controlling the motion of the multi-channel pipetting head to move either horizontally, vertically, or both, with respect to the deck in response to the direction of force applied to the control handle by the user.

2. The electronic multi-channel pipetting system recited in claim 1 further comprising the carriage for the pipetting head, and wherein the control handle is mounted to the carriage for the pipetting head.

3. The electronic multi-channel pipetting system recited in claim 1 wherein the control handle is adapted to be held within the palm of a user's hand.

4. The electronic multi-channel pipetting system recited in claim 1 wherein the drive mechanism comprises:

an x-axis drive mechanism including a motor for moving the multi-channel pipetting head laterally in response to lateral force applied to the control handle.

5. The electronic multi-channel pipetting system recited in claim 1 wherein the drive mechanism comprises:

a z-axis drive mechanism including a motor for moving the multi-channel pipetting head vertically downward towards the deck in order to place a lower end of pipette tips mounted on the tip fittings of the multi-channel pipetting head within or above wells of a multi-well plate loaded onto the deck, and also vertically upward away from the deck.

6. The electronic multi-channel pipetting system recited in claim 1 further comprising:

a tower to which the multi-channel pipetting head is mounted for vertical movement with respect to the tower and wherein the drive mechanism comprises:

a lateral drive mechanism including a motor for moving the tower laterally in response to lateral force applied to the control handle; and a vertical drive mechanism including a motor for moving the multi-channel pipetting head vertically with respect to the tower towards the deck in order to place a lower end of pipette tips mounted on the tip fittings of the multi-channel pipetting head within or above wells of a multi-well plate loaded onto the deck, and also vertically upward away from the deck.

7. The electronic multi-channel pipetting system recited in claim 1 wherein the system further comprises a run button located on the control handle, which instructs the system to aspirate and dispense.

8. The electronic multi-channel pipetting system recited in claim 1 wherein a first and second multi-well plate nesting receptacle are located on the deck.

9. The electronic multi-channel pipetting system recited in claim 4 wherein a first and second multi-well plate nesting receptacle are located on the deck; and the x-axis drive motor is able to move the multi-channel pipetting head into a position located above the first multi-well plate nesting receptacle and also into a second position in which the multi-channel pipetting head is located above the second multi-well plate nesting receptacle.

10. The electronic multi-channel pipetting system recited in claim 1 wherein the multi-channel pipetting head has 96-tip fittings arranged in an 8 by 12 array.

11. The electronic multi-channel pipetting system recited in claim 1 wherein the multi-channel pipetting head has 384-tip fittings arranged in a 16×24 array.

12. The electronic multi-channel pipetting system recited in claim 11 wherein the pipette tip fittings are part of a removable pipetting head.

13. The electronic multi-channel pipetting system recited in claim 6 wherein the pipetting motor is mounted to the tower, and the system further comprises:

a removable pipetting head containing a piston and cylinder assembly that is in fluid communication with the array of pipetting channels and is driven by the pipetting motor in order to aspirate liquid sample into and dispense liquid sample from disposable pipette tips mounted to the pipetting head.

14. The electronic multi-channel pipetting system recited in claim 1 further comprising:

a user interface display located on a front side of the control handle;

an ejector button located on the control handle;

a microprocessor; and software for controlling the information displayed on the user interface display and for programming the microprocessor to operate the system;

wherein an ejection confirmation inquiry is displayed on the display once the ejector button is activated and a control signal to strip pipette tips is generated only after the user confirms that tip ejection is desired.

15. The electronic multi-channel pipetting system recited in claim 1 further comprising:

a movable carriage and at least one multi-well plate receptacle on the deck;

wherein the multi-channel pipetting head is a removable multi-channel pipetting head carried in the movable carriage; and wherein the carriage includes longitudinal wedge surfaces for securing the removable pipetting head to the carriage, and the system further comprises means for setting a lateral offset position for the removable pipetting head with respect to the at least one multi-well plate nesting receptacles on the deck.

16. The electronic multi-channel pipetting system recited in claim 1 wherein the deck holds at least two multi-well plates, two tube racks or reservoirs.

17. An electronic multi-channel pipetting system comprising:

a multi-channel pipetting head having a plurality of pipetting channels arranged in a two-dimensional array of rows and columns;

a pipetting motor that drives the multi-channel pipetting head to aspirate and dispense;

a deck for holding at least two multi-well plates, tube racks or reservoirs, each multi-well plate having a plurality of wells arranged in a two-dimensional array of rows and columns; and a control handle that is operated by a user of the multi-channel pipetting system, wherein the multi-channel pipetting head moves either horizontally, vertically, or both, with respect to the deck in response to the direction of force applied to the control handle by the user;

a load cell, wherein the control handle is mounted on the load cell such that the load cell detects force direction and magnitude applied to the control handle by the user; and an electronic control system that controls the motion of the multi-channel head generally in proportion to the force direction and magnitude detected by the load cell.

18. The electronic multi-channel pipetting system recited in claim 17 wherein the electronic motion control system limits the range of motion of the pipetting head within pre-selected motion limits.

19. The electronic multi-channel pipetting system recited in claim 18 wherein the electronic motion control system decelerates the pipetting head as it approaches a pre-selected motion limit even if the load cell detects a conflicting force.

20. An electronic multi-channel pipetting system comprising:

a multi-channel pipetting head having a plurality of pipetting channels arranged in a two-dimensional array of rows and columns;

a pipetting motor that drives the multi-channel pipetting head to aspirate and dispense;

a deck for holding at least two multi-well plates, tube racks or reservoirs, each multi-well plate having a plurality of wells arranged in a two-dimensional array of rows and columns; and a control handle that is operated by a user of the multi-channel pipetting system, wherein the multi-channel pipetting head moves either horizontally, vertically, or both, with respect to the deck in response to the direction of force applied to the control handle by the user; and further wherein the control handle comprises:

an elongated body adapted to be held in the hand of the user;

a touch wheel control located on a front side of the control handle body to be operated by the user; and a dot matrix user interface display located on the front side of the control handle body above the touch wheel control.

21. The electronic multi-channel pipetting system as recited in claim 20 wherein the system further comprises:

one or more microprocessors; and menu-driven software for controlling information displayed on the user interface display and for programming the one or more microprocessors to operate the system wherein at least some of the information is displayed as a menu of options; and wherein the touch wheel comprises a circular touch pad that translates rotational movement of a thumb or finger into cursor movements on the display in order to navigate the menu-driven software.

22. The electronic multi-channel pipetting system recited in claim 21 wherein the circular touch pad includes four selector locations, namely a back button located at the top of the circular touch pad, a purge button located at the bottom of the circular touch pad and right and left navigation buttons located at the right side and the left side of the circular touch pad, respectively.

23. The electronic multi-channel pipetting system recited in claim 20 wherein the touch wheel control further comprises an enter button located at the center of the touch pad.

* * * * *